United States Patent [19]

Hull

[11] Patent Number: 4,663,994

[45] Date of Patent: May 12, 1987

[54] EASY LIFT-TAB CONTAINER OPENER

[76] Inventor: Alan Hull, 600 9th Ave., Seattle, Wash. 98104

[21] Appl. No.: 828,508

[22] Filed: Feb. 12, 1986

[51] Int. Cl.[4] ..... B67B 7/00

[52] U.S. Cl. ..... 81/3.27; 81/3.36

[58] Field of Search ..... 81/3.25, 3.27, 3.07, 81/3.36, 3.55

[56] References Cited

U.S. PATENT DOCUMENTS

| | | | |
|---|---|---|---|
| 3,572,186 | 3/1971 | Dillard | 81/3.27 |
| 4,455,894 | 6/1984 | Roberts | 81/3.55 |
| 4,524,646 | 6/1985 | Kimberlin, Jr. | 81/3.55 |
| 4,563,919 | 1/1986 | Sellars | 81/3.55 |

*Primary Examiner*—Roscoe V. Parker

[57] ABSTRACT

A formed, or molded, wall mounted bracket which extends horizontally from a mounting surface and serves to "one-handedly" raise a lift-tab on beverage cans and others, so equipped, by placing the upper surface of the above mentioned cans beneath a downward projecting nose at the individual's end of said bracket and pushing the container in one smooth motion toward the bracket, thus causing the downward facing projection to wedge the lift-tab upward and through an arc of nearly 100° and, further causing the lift-tab to break the container's seal which, in turn allows the individual access to the contents within.

3 Claims, 8 Drawing Figures

EASY LIFT-TAB CONTAINER OPENER

TECHNICAL FIELD

This invention concerns gaining access to the contents of metal containers which are commonly in use, today, for holding such liquids as soft drinks, ales, beer, engine additives, oil, chemical compounds and the like.

BACKGROUND ART

My invention further pertains to improvements of mechanisms required to open containers using "lift-tabs" to gain access to their contents. Examples of such containers can be found in the following U.S. patents:

U.S. Pat. No. 4,361,251 Langseder, granted Nov. 30, 1982 for "Detachment Resistant Retained Lever".

U.S. Pat. No. 4,322,016 Barrash, granted Mar. 30, 1982 for "Proof of Purchase Means for Self-Opening Cans".

U.S. Pat. No. 4,524,646 Kimerlin, granted June 28, 1985 for "Tab Can Opener Tool". but lift-tabs are generally located in a restrictive recess below the upper rim of the container, which allows only for manual opening, usually without any other means than the dexterity of human thumbs and fingers.

Further, it entails the use of both hands, generally, to do it—one to grip the container, as the other lifts and operates the tab.

In many business establishments, such as automobile service stations, soda fountains, taverns and the like, containers may be opened in numbers of hundreds or more each day by single individuals.

Other persons, such as the aged, physically challenged, or less desterous, for other reasons, often find it difficult, or impossible to lift the tabs sufficiently to break the seal and gain access to the contents.

Therefore, the principal problem to be solved is to provide a simple means to lift the tab, break the seal, and gain access to the contents with a simple, efficient, single movement using one hand only.

DISCLOSURE OF INVENTION

This invention contemplates the use of a fixture that can be adhesively, or fastener, mounted to a wall, bracket, counter, or any rigid object easily accessible to the individual.

The accompanying illustrations also show the manner in which the container is grasped, positioned, and moved toward the fixture and shows how the lift-tab is positioned and initially raised as the container is moved toward the fixture. Follow-through motion cams the pull-tab up as the container slides toward the fixture. As the container's upper rim contacts the lower, sloping edges of the fixture, additional movement ramps the container downward, thus making the pull-tab rise to a steeper angle which, in turn, breaks the seal and bends it downward and out of the path of the flowable materials within.

BRIEF DESCRIPTION OF THE DRAWINGS

In the following detailed description reference is made to the accompanying drawings wherein.

It further illustrates how the container's lift-tab is oriented and positioned, with respect to the fixture device of this invention, prior to opening the container.

Figure 2:
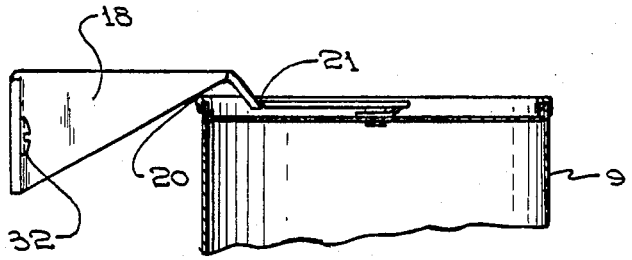

FIG. 2 is a side elevational view of the fixture device, along with the upper portion of the container, with a section, at the top, cut away so as to view the lift-tab, its attached hinge, its seal opening tang and the seal, prior to being opened.

It further illustrates the upward slopping nose of the fixture projecting slightly under, and in contact, with the lower surface of the pull-tab while, at the same time, it shows the upper rim of the container in contact with the lower sloping edge of each side of the fixture.

Figure 3:
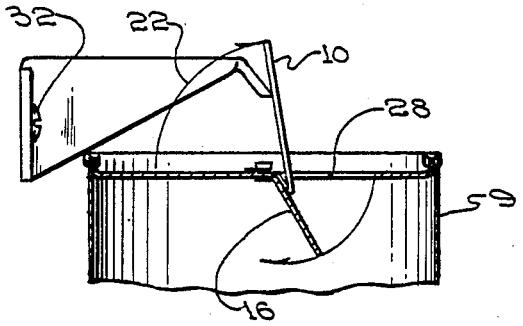

FIG. 3 is a side elevational view of the fixture along with the upper portion of the container, with a section, at its top, cut away so as to view the hinged pull-tab as it is raised, due to the container's further motion toward the fixture.

It also shows how the tang of the pull-tab is levered downward to make contact with the top of the container's seal at the near-center point of the seal, thus breaking it along the perimeter where it had been coined, and weakened, and forces it, further, to bend downward at its hinge point.

It also shows how the container is forced downward by the lower ramped edges at each side of the fixture as the container is caused to move further toward the fixture.

Figure 4:
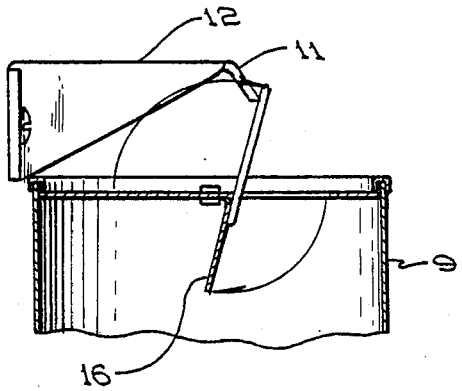

FIG. 4 is a side elevational view of the fixture, along with the upper portion of the container, with a section of its top cut away. It also illustrates the final stage of having directed the container toward the fixture and shows how the double action of the container, in constant contact with the fixture's lower, sloping sides, and the container's continuing downward motion, along with the pull-tab's upward arcing motion, due to its continued contact with the sloping nose of the fixture, has now raised the pull-tab to its highest raiseable position. Its upward arc, in turn, has caused the pull-tabs tang to bend the seal downward to a point where the container's opening is now totally exposed to allow an escape path for the flowable material within the container.

Figure 5:
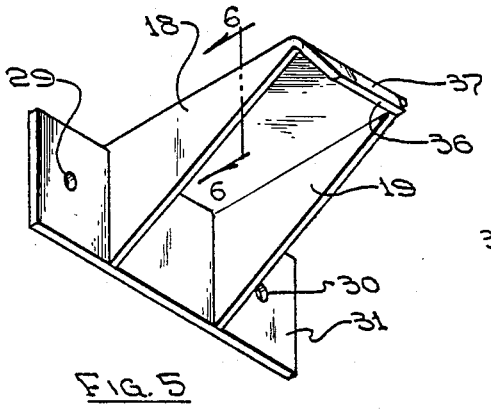

FIG. 5 is an isometric illustration and views the fixture from below.

It also illustrates the fixture as it might be formed from sheet material, such as light gauge metal, or other material and further illustrates its full shape after having been formed.

Figure 6:
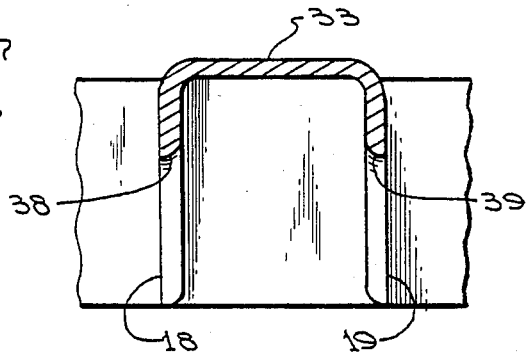

FIG. 6 is a sectional front view of the fixture as viewed through Section 6-6 of FIG. 5. It also illustrates the required rounded inner corners of the sides which provide for a smooth, continuous path for the container's rim to slide upon as it is directed toward the fixture upon opening the container.

Figure 7:
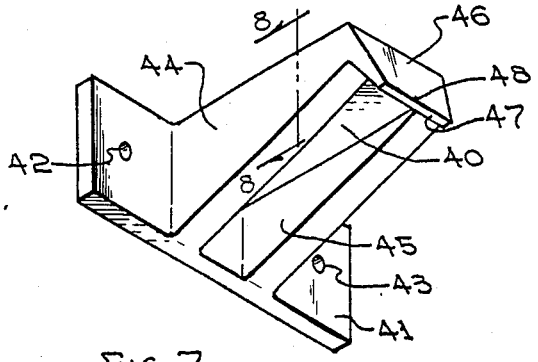

FIG. 7 is an isometric illustration, as viewed from below, of a fixture device of this invention as it might be formed of moldable plastic material and shows its overall appearance as a one piece molding, but with the shapes and features in full keeping with the formed fixture described beforehand.

Figure 8:
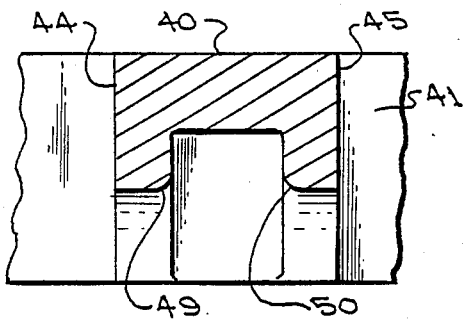

FIG. 8 is a sectional front view of the molded fixture as viewed through Section 8-8 of FIG. 7. It also illustrates the required rounded inner corners of the sides which provide the same function as illustrated in the formed version in FIG. 6.

BEST MODE FOR CARRYING OUT THE INVENTION

Figure 1:
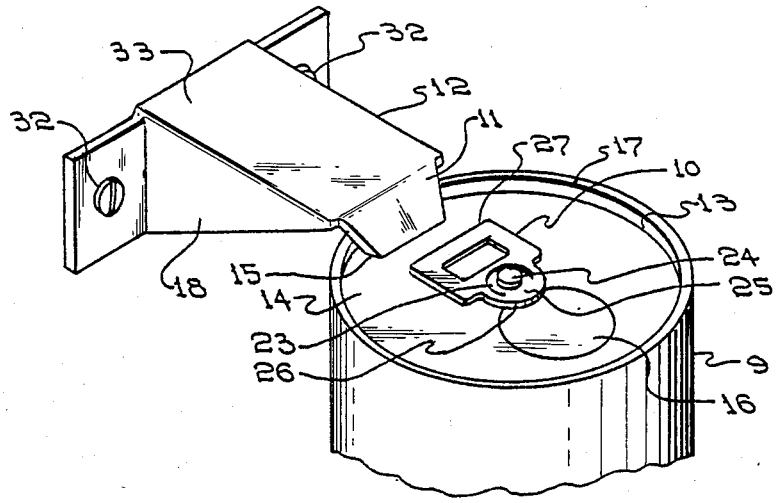
FIG. 1 is an isometric illustration, as viewed from above showing the fixture device of this invention, and one method of fastening the fixture as it might be used on a wall, a counter edge, table edge, or other vertical surface. It further illustrates the upper portion of a typical metal container, a lift-tab, its seal opening lever portion and the container's sealing device.

In FIG. 1 a container to be opened (9) is grasped in the hand of an individual (not shown) and oriented in such a way as to position the lift-tab (10) towards the ramped nose (11) of the fixture (12). The container's upper rim (13) is brought up under, and slightly behind the nose (11) and lifted until contact is made between the container's upper surface (14) and lowest edge (15) of the nose (11), thus readying the container in the first step of breaking open the container's seal (16).

As the container (9) is slid toward the fixture (12), the upper edge (17) of the containers rim (13) makes contact with the lower edges of the fixture's sides (18 and 19, FIGS. 1 through 8) as shown as point-of-contact (20, FIG. 2).

At this point the lower edge (15) of the fixture's nose (11) has also made contact with lower leading edge of the lift-tab (10) as shown at point-of-contact (21, FIG. 2). As the container (9) continues to be moved toward the fixture (12), as shown in FIG. 3, the lift-tab (10) is wedged upward and through an arc (22) while, at the same time, the container (9) has been ramped downward in its travel forward. This double separating action is especially effective in smoothly camming the lift-tab upward.

The lift-tab (10) has a small central surface which has a partially perforated area (23), punched through its center and through which a rivet, or other fastener (24), connects it rigidly to the upper surface of the container (9) as seen in FIG. 1. The unperforated portion (25) serves as a hinge point for the lift-tab (10) and generally bends very easily while still giving sufficient strength to keep from breaking when it is needed. A further feature of the lift-tab (10) is the heel (26), near the hinge point (25), that is levered downward to make contact with the container's seal as the leading edge (26) of the lift-tab raises, thus effectively bearing down on the upper surface of the seal (16) and breaking it open where it was, initially, coined and weakened during the manufacture of the container (9).

FIG. 4 shows the lift-tab (10) at the highest point of its described arc and illustrates how the upward sloping nose (11) of the fixture (12) has remained in constant contact with the lower surface of the lift-tab (10) throughout the operation of directing the container (9) toward the fixture. It also shows how the heel (26) of the lift-tab (10), in the course of its arc downwards, has bent the seal tab (16) down, and out of the way of the container's opening (28) FIG. 3.

The container (9), now having been fully opened, leaves only one undone operation, in most cases—that of pressing the raised lift-tab out of the way of the container's opening (28).

At this point the individual may elect to do it by hand, by the use of finger, or thumb. By turning the container around and, again, using the nose (11), the lift-tab (10) may be pushed back, and down to its original position before the container was opened; thus fully completing its intended functions.

It may now be noted that at no time has it been necessary to use two hands to raise the lift-tab (10) to open a container, nor to depress it after opening.

FIG. 5, as noted before, is a low angle view, looking upward, at a formed fixture device, whose function has been previously described, and shows its various features in their entirety.

A vertical, flat portion, with holes (29) and (30) drilled, or punched, through its face, serves as the fixture's mounting bracket (31) and allows an individual to locate and mount the fixture to any accessible vertical surface as may be desired, by use of adhesives, or mounting screws (32) as illustrated best in FIG. 1.

A horizontal, flat, upper plane (33) serves as the fixtures spine, upon which two tapering sides (18) and (19) are shown, along with a frontal downward angling plane, or nose (11). At the lower edge of the nose (11) a horizontal flat surface (36) is ground upon it to give its leading edge (37) a slight knife edge which allows it to find its way under the leading edge (27) of the lift-tab (10) when it is initially positioned, previous to opening the container (9).

FIG. 6 is a frontal, cross-sectional view, through Section 6—6 of FIG. 5, as has been previously noted. It illustrates where the lower inside edges (38) and (39) of the fixture's sides (18) and (19) are smoothed and rounded throughout the length of each side's lower edges.

If left sharp, as they are during manufacture, upon being punched and formed, the otherwise sharp cornered inner edges would cut into the upper rim of the container to be opened, and gall. By being rounded, as shown, two smooth bearing surfaces are provided which allows the container's contacting surfaces to glide smoothly, and unaffected, during any operation of opening a container.

FIG. 7 illustrates, from slightly below, a one-piece "molded" form of the fixture device, as has been described in FIGS. 1 through 6, and shows the many similarities between the two, and how the molded product provides all of the required parts and shapes needed to perform all of the "formed" fixture's functions.

Shown in FIG. 7 are the fixture's horizontal spine (40), mounting bracket (41), mounting bracket holes (42) and (43), the fixture's two sides (44) and (45) and the fact that their lower edges also taper downward toward the mounting bracket (41), and the slightly projecting ramped nose (46) at the very front of the fixture device. It also shows the small, flat undersurface (47) and knife edge (48) at the lower frontal edge of the nose (46).

FIG. 8 is a frontal, cross-sectional view, through Section 8—8 of FIG. 7, as has been previously noted. It illustrates where the lower inside edges (49) and (50) of the fixture's sides (44) and (45) are molded smooth and round throughout the length of each side's lower edges, and provide a bearing surface for the container's contacting surfaces to glide smoothly, and unaffected, during any operation of opening a container.

As in many openers, using two hands, or as manually opening a container, spray rises at the moment a seal is broken, due to internal pressure. It is immediately messy, hands get wet, and much of the spray returns to the contents of the container—possibly with contaminating results. It may also be extremely dangerous to the individual if the contents are caustic, or acidic.

There are no internal cavities to collect and retain the sprayed materials and may thus be easily wiped, or washed clean—a definite requirement by all health standards and organizations.

What is claimed is:

1. A fixture for manually opening a plurality of containers, equipped with seals and having rims with upper surfaces and also equipped with lift-tab devices which are needed for breaking said seals, said devices having upwardly swinging first blades, leading edges and heels and wherein said fixture comprises a second blade including an upward sloping frontal surface and a pair of sides including downwardly sloping edges having bottom, said second blade, when positioned properly beneath and in front of said upwardly swinging first blades of the container's lift-tabs and advanced, manually and with one hand only, toward the opener fixture, wedges said leading edges of the lift-tab devices upwards while at the same time said upper surface of said rim of said container contacts and slides down said bottoms of said downwardly sloping edges of the said second blade's sides, thus causing the container to ramp downward at the same time the container is manually advanced toward the fixture, thus further increasing, progressively, the angle of the container lift-tab's arc as it is bent upwards until the container's seal has been broken and bent downward by said heel contacting said seal and causing sufficient downward force to break said seal and, further, bending it downward and through an arc sufficient to clear an opening large enough to allow the container's contents to flow freely from said container.

2. A fixture device of claim 1 comprised of an upper surface which acts as the fixture's spines and which has two vertical sides that span the spine's entire length and are further distinguished by tapering lower edges which begin at the spine's farthest forward point and deepen, at a constant angle, as the lower edges progressively span the spine's entire length; a wide, narrow, vertical surface attached, in one piece, to the fixture's spine, which acts as the fixtures mounting bracket and against which the fixture's sides make contact, at their lowest point and are further supported and braced thereby; a downward sloping frontal blade which is an extension of the fixture's spine, said blade having a nearly sharp leading edge and whose forward bottom surface is ground or formed horizontally flat and smooth to serve as a bearing surface between the aforementioned blade and the upper surface of the container to be opened, said bracket portion being further distinguished by having the spine and its two lower adjoining sides centered on its forward vertical surface and further by having two small holes (one to each side of the spine and its two lower sides) through which fasteners may pass to secure the fixture device to any accessible vertical surface such as a wall, bracket, table edge, or counter edge as may be desired.

3. The fixture device of claim 2 further characterized in that the corners located on the lower innermost portions of each of the sides are rounded throughout the entire length of each side's lower sloping edge to ensure a smooth slide surface for the upper rim of the container to contact and glide downward on while being directed toward the fixture when opening the container, thus further ensuring that sharp knife edges which would cut ridges in the container's contacting surfaces and thus cause galling and interrupted motion are eliminated.

* * * * *